US011296458B2

(12) United States Patent
Penn et al.

(10) Patent No.: US 11,296,458 B2
(45) Date of Patent: Apr. 5, 2022

(54) CONNECTOR ASSEMBLY WITH DIRECT MOUNT HOUSING

(71) Applicant: Aptiv Technologies Limited, St. Michael (BB)

(72) Inventors: Matthew L. Penn, Cortland, OH (US); Jose Alberto Davila Aleman, Saltillo (MX)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/998,364

(22) Filed: Aug. 20, 2020

(65) Prior Publication Data

US 2020/0403356 A1 Dec. 24, 2020

Related U.S. Application Data

(63) Continuation of application No. 16/391,701, filed on Apr. 23, 2019, now Pat. No. 10,826,234.

(60) Provisional application No. 62/661,277, filed on Apr. 23, 2018.

(51) Int. Cl.

| | |
|---|---|
| ***H01R 13/627*** | (2006.01) |
| ***H01R 24/40*** | (2011.01) |
| ***H01R 43/26*** | (2006.01) |
| ***H01R 13/50*** | (2006.01) |
| *H01R 103/00* | (2006.01) |
| *H01R 13/631* | (2006.01) |

(52) U.S. Cl.

CPC ..... *H01R 13/6273* (2013.01); *H01R 13/50* (2013.01); *H01R 24/40* (2013.01); *H01R 43/26* (2013.01); *H01R 13/631* (2013.01); *H01R 2103/00* (2013.01)

(58) Field of Classification Search

CPC .. H01R 13/6273; H01R 13/50; H01R 13/631; H01R 24/40; H01R 43/26; H01R 2103/00

USPC ..... 439/357

See application file for complete search history.

(56) References Cited

U.S. PATENT DOCUMENTS

| | | | | |
|---|---|---|---|---|
| 6,361,348 | B1 * | 3/2002 | Hall | H01R 13/6277 439/352 |
| 6,491,542 | B1 | 12/2002 | Zerebilov | |
| 6,824,403 | B2 * | 11/2004 | Hall | H01R 24/50 439/108 |
| 7,267,570 | B2 * | 9/2007 | Fry, Jr. | H01R 13/6272 439/357 |
| 7,285,011 | B2 * | 10/2007 | Hardy | H01R 13/506 439/582 |
| 7,347,742 | B2 * | 3/2008 | Hall | H01R 13/6272 439/542 |
| 7,399,195 | B2 * | 7/2008 | Kim | H01R 13/641 439/352 |
| 7,470,138 | B1 * | 12/2008 | Chen | H01R 13/506 439/352 |
| 7,563,103 | B1 * | 7/2009 | Hall | H01R 24/50 439/581 |

(Continued)

FOREIGN PATENT DOCUMENTS

CN 203521819 U 4/2014

*Primary Examiner* — Peter G Leigh

(74) *Attorney, Agent, or Firm* — Billion & Armitage

(57) ABSTRACT

An electrical connector assembly includes a housing configured to receive an electrical terminal. Opposed sides of the housing each define a pair of parallel locking ribs forming a locking slot therebetween. Each locking slot is configured to receive a locking arm extending from a separate mounting bracket.

20 Claims, 7 Drawing Sheets

(56) References Cited

U.S. PATENT DOCUMENTS 7,762,854 B1 * 7/2010 Peng ..... H01R 13/508 439/752
7,794,274 B2 * 9/2010 Phillips, Jr. ..... H01R 24/542 439/578
7,887,359 B2 * 2/2011 Manser ..... H01R 13/6272 439/350
7,980,894 B1 * 7/2011 Hall ..... H01R 9/053 439/585
8,182,285 B2 * 5/2012 Annequin ..... H01R 24/54 439/582
8,251,762 B2 * 8/2012 Maier ..... H01R 13/64 439/892
8,277,248 B2 * 10/2012 Blakborn ..... H01R 24/52 439/581
8,366,483 B2 2/2013 Hardy et al.
8,500,486 B2 * 8/2013 Buck ..... H01R 13/74 439/551
9,281,619 B2 * 3/2016 Morello ..... H01R 13/6272
9,318,836 B2 * 4/2016 Yagi ..... H01R 13/502
9,368,909 B2 * 6/2016 Yagi ..... H01R 13/6272
9,537,231 B2 1/2017 Hall et al.
9,666,972 B2 * 5/2017 Martin ..... H01R 13/506
9,680,256 B1 * 6/2017 Lane ..... H01R 13/639
9,762,001 B2 * 9/2017 Morello ..... H01R 13/641
9,876,313 B2 * 1/2018 Endo ..... H01R 13/629
9,929,509 B1 * 3/2018 Penn ..... H01R 13/6272
9,935,399 B2 * 4/2018 Sekino ..... H01R 13/641
D878,303 S 3/2020 Penn et al.
2003/0171027 A1 * 9/2003 Shuey ..... H01R 13/641 439/489
2004/0058582 A1 * 3/2004 Wendling ..... H01R 9/0518 439/582
2007/0020986 A1 * 1/2007 Fry, Jr. ..... H01R 13/6272 439/357
2007/0093120 A1 * 4/2007 Hardy ..... H01R 13/508 439/468
2009/0017678 A1 * 1/2009 Meier ..... H01R 9/0518 439/582
2010/0112844 A1 * 5/2010 Manser ..... H01R 13/6272 439/350
2011/0008999 A1 * 1/2011 Annequin ..... H01R 24/54 439/582
2011/0217870 A1 9/2011 Blakborn
2011/0230092 A1 * 9/2011 Maier ..... H01R 13/64 439/578
2012/0202372 A1 * 8/2012 Hardy ..... H01R 13/5804 439/460
2015/0244115 A1 * 8/2015 Yamaguchi ..... H01R 13/6581 439/580
2016/0134032 A1 * 5/2016 Hall ..... H01R 13/434 439/578
2017/0214191 A1 * 7/2017 Lane ..... H01R 43/16
2017/0222368 A1 * 8/2017 Morello ..... G01R 31/58
2017/0271815 A1 * 9/2017 Lane ..... H01R 13/641
2018/0026408 A1 * 1/2018 Ensley ..... H01R 24/38 439/578
2018/0034172 A1 * 2/2018 Singhammer ..... H01R 13/514
2018/0076579 A1 * 3/2018 Tokita ..... H01R 13/506
2018/0097309 A1 4/2018 Haspel et al.
2018/0248292 A1 * 8/2018 Hashiguchi ..... H01R 13/506
2019/0326706 A1 * 10/2019 Penn ..... H01R 24/40

* cited by examiner

CONNECTOR ASSEMBLY WITH DIRECT MOUNT HOUSING

CROSS-REFERENCE TO RELATED APPLICATION

This continuation application claims the benefit under 35 U.S.C. § 120 of co-pending U.S. patent application Ser. No. 16/391,701, filed Apr. 23, 2019, which claimed the benefit under 35 U.S.C. § 119(e) of U.S. Provisional Patent Application No. 62/661,277, filed Apr. 23, 2018, the entire disclosure of each is hereby incorporated herein by reference.

TECHNICAL FIELD OF INVENTION

This disclosure generally relates to an electrical connector assembly with direct mount features.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well known methods, procedures, components, circuits, and networks have not been described in detail so as not to unnecessarily obscure aspects of the embodiments.

Figure 1:
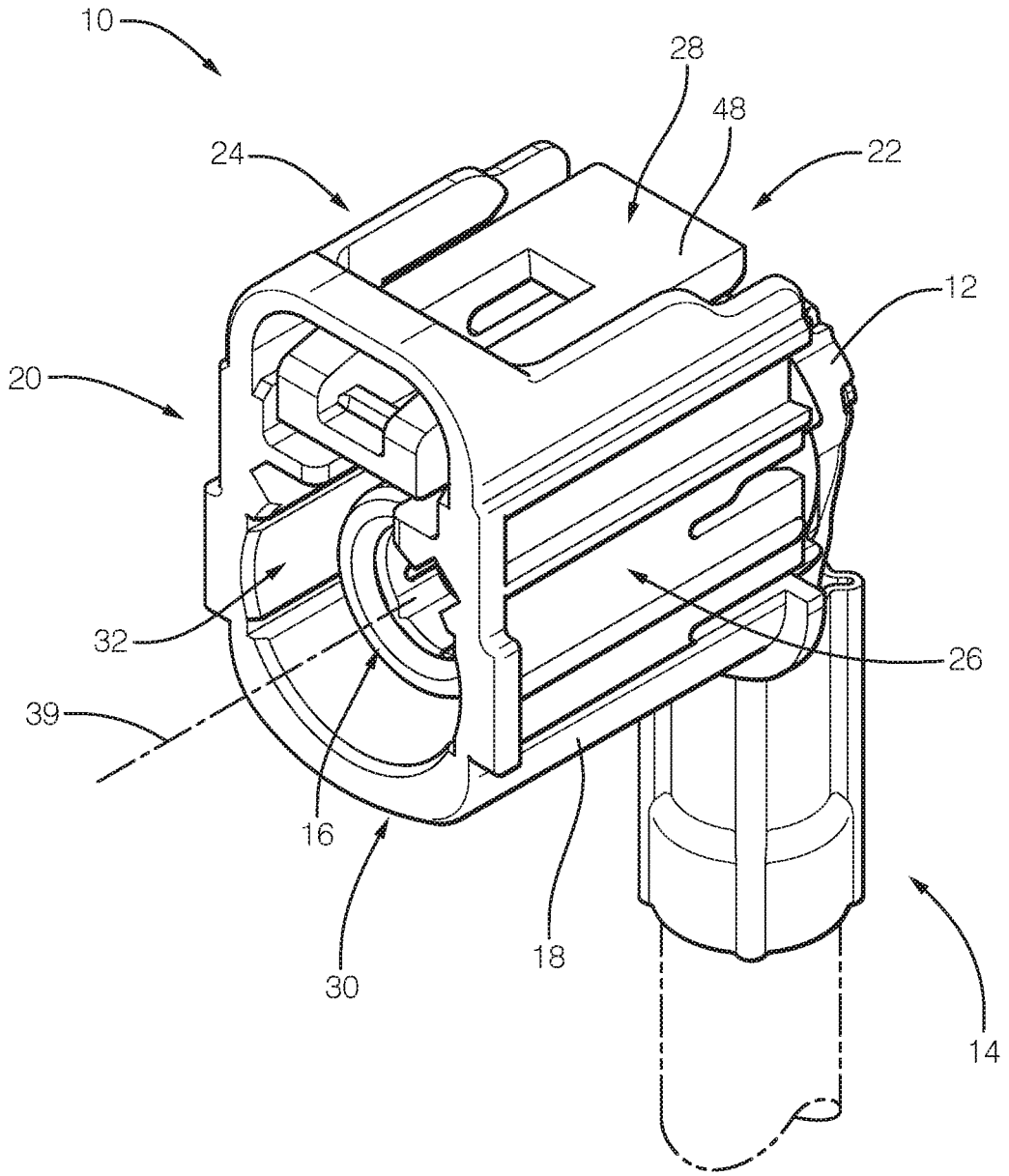
FIG. 1 is a perspective view of a connector assembly in accordance with one embodiment.

FIG. 1 illustrates a connector assembly 10, hereafter referred to as the assembly 10. The assembly 10 is configured to be directly mounted to a bracket and provide structural support for a mating connector (not shown). The assembly 10 includes a coaxial electrical terminal 12 configured to receive a corresponding coaxial electrical terminal (not shown). The coaxial electrical terminal 12 has a wire end 14 and a terminal end 16 oriented orthogonal to the wire end 14. That is, the wire end 14 and the terminal end 16 are oriented 90 degrees from one another (i.e., a right-angle terminal). The coaxial electrical terminal 12 is configured to be attached to a wire cable (not shown) at the wire end 14, that may be a component of a wiring harness of a vehicle.

In the example illustrated in FIG. 1, the coaxial electrical terminal 12 is compatible with a Fachkreis Automobil (FAKRA) standard, hereafter referred to as FAKRA. FAKRA is an electrical standard that defines coaxial connectors used in automotive communication systems that include global positioning systems (GPS), satellite radio, cellular phone, and some FM radio signals. FAKRA defines several different configurations of female and male connector housings, and configurations of electrical terminals retained by the connector housings.

The assembly 10 also includes a housing 18 formed of a polymeric dielectric material. The polymeric dielectric material may be any polymeric dielectric material capable of electrically isolating portions of the coaxial electrical terminal 12. In an example, the polymeric dielectric material is a polyamide (NYLON) material. In another example, the polyamide includes a glass fiber fill. In another example the polymeric dielectric material is polypropylene. The housing 18 is configured to mate with a corresponding housing that retains the corresponding coaxial electrical terminal of the mating FAKRA connector.

The housing 18 has a first end 20 and a second end 22 opposite the first end 20, a first side 24 and a second side 26 opposite the first side 24, and a top side 28 and a bottom side 30 opposite the top side 28. The top side 28 includes a connector lock 48 configured to releasably lock the mating connector to the assembly 10 in a mated position. In an example, a wall thickness of the first side 24 and the second side 26 of the housing 18 is less than 1.0 mm, and the wall thickness of the bottom side is less than 1.5 mm. The relatively thin wall thicknesses enable a smaller packaging envelope compared to other assemblies, and a reduced material cost.

Figure 2:
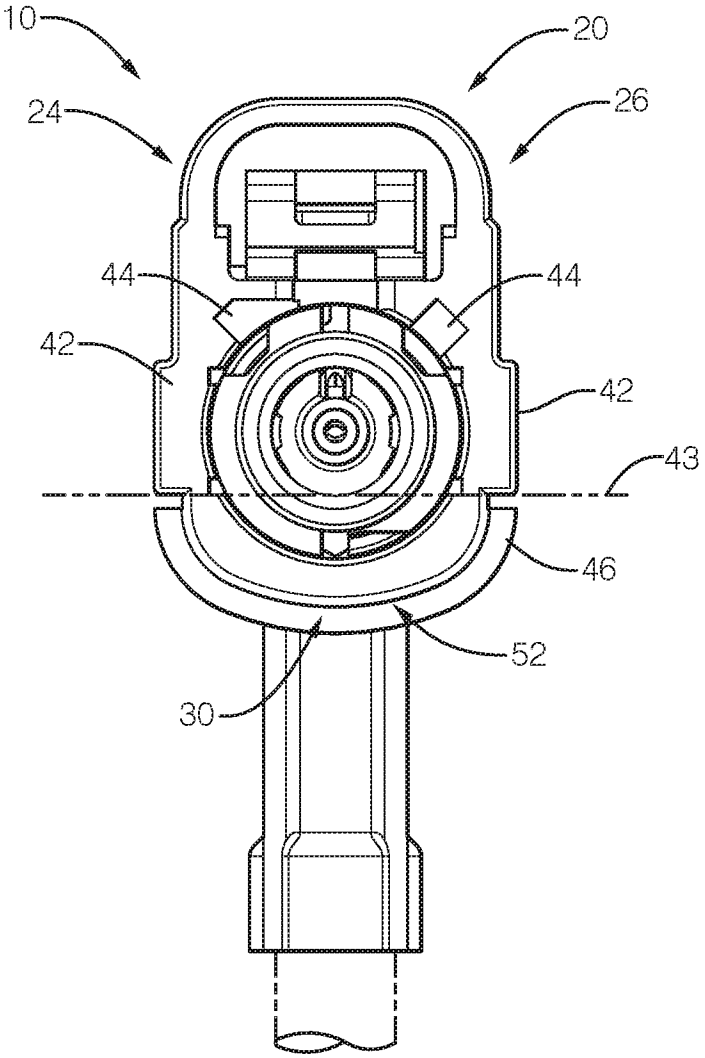
FIG. 2 is a front view of the connector assembly of FIG. 1 in accordance with one embodiment.
Figure 9:
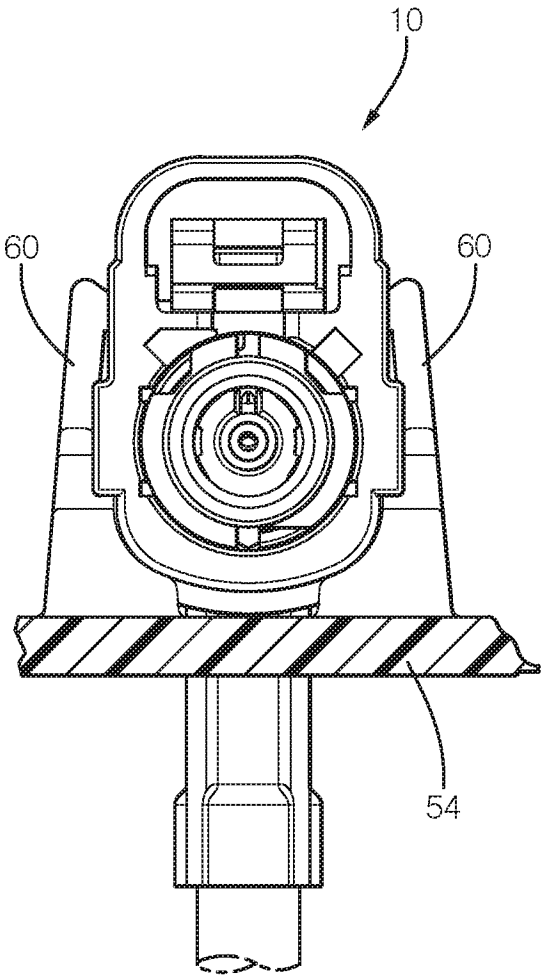
FIG. 9 is a front view of the connector assembly of FIG. 1 retained in the corresponding mounting bracket in accordance with one embodiment.

FIG. 2 is a front view of the assembly 10 of FIG. 1 and illustrates the first end 20 of the housing 18. The first end 20 of the housing 18 includes a first flange 42 extending beyond a portion of both the first side 24 and the second side 26. The first end 20 defines indexing features 44 recessed into the first end 20 proximate the top side 28 of the housing 18. The indexing features 44 are compatible with FAKRA and are configured to receive corresponding indexing features 44 from the mating FAKRA connector. The first flange 42 is configured to engage a shoulder on a corresponding mounting bracket 54 (see FIG. 9) and inhibit movement along the mating axis 39 and inhibit rotation of the assembly 10 about the mating axis 39. The first flange 42 is positioned above a longitudinal plane 43 defined by the housing 18 and is orthogonal the longitudinal plane 43. In an example, a thickness of the first flange 42 is less than 1.5 mm.

Figure 3:
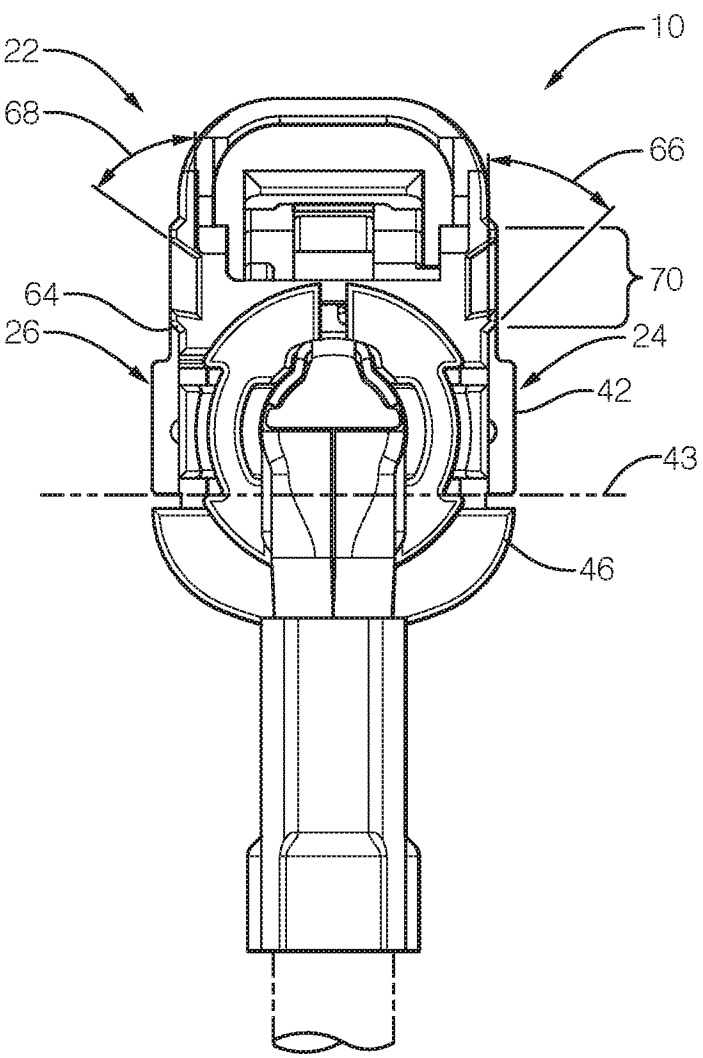
FIG. 3 is a rear view of the connector assembly of FIG. 1 in accordance with one embodiment.
Figure 8:
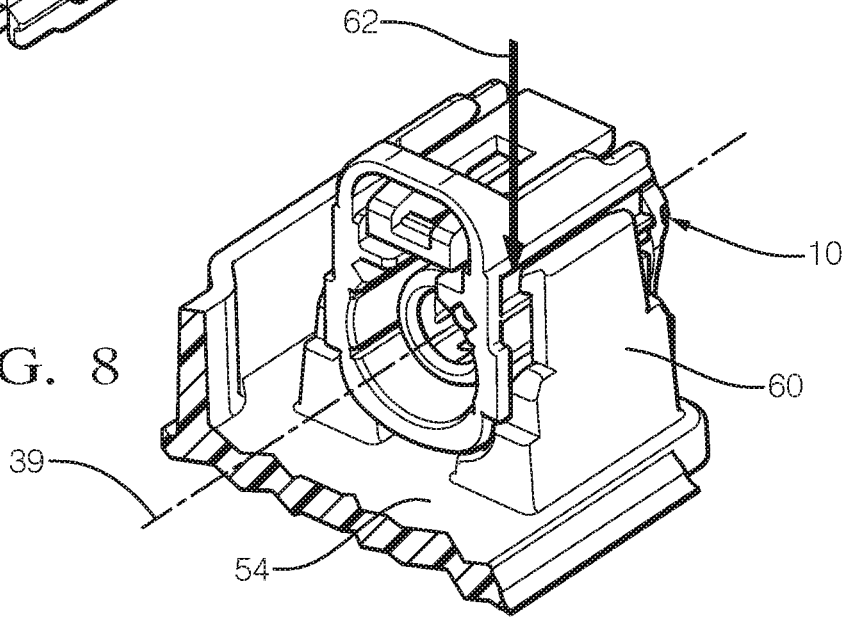
FIG. 8 is a top perspective view of the connector assembly of FIG. 1 retained in a corresponding mounting bracket in accordance with one embodiment.
Figure 11:
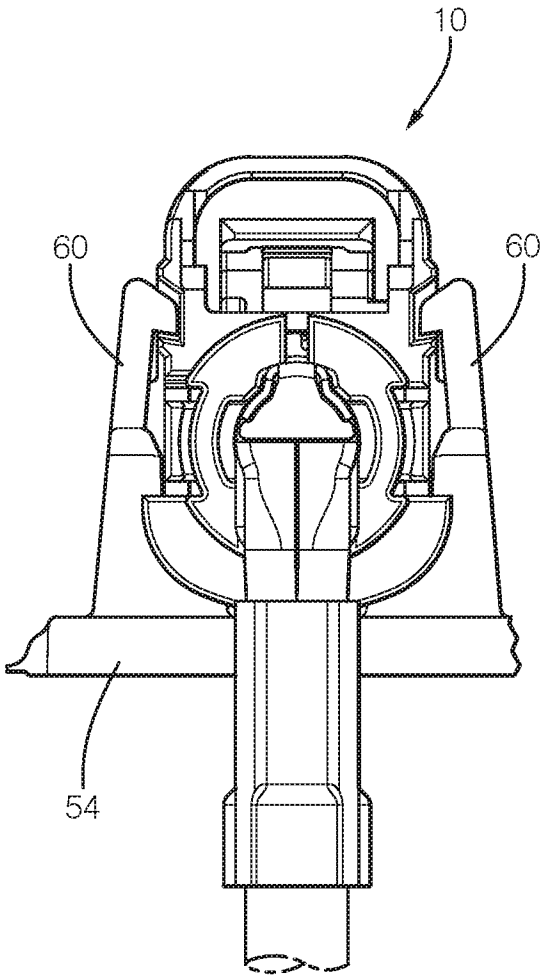
FIG. 11 is a rear view of the connector assembly of FIG. 1 retained in the corresponding mounting bracket in accordance with one embodiment.
Figure 10:
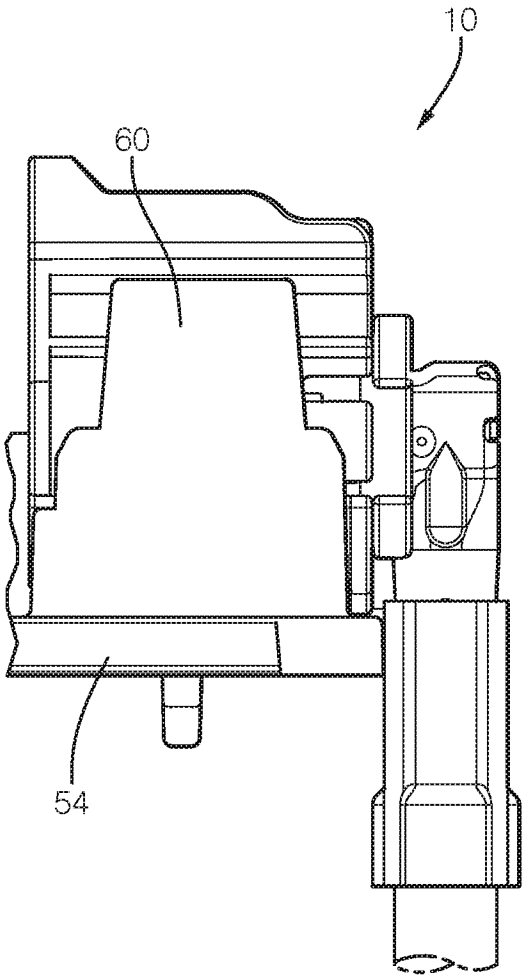
FIG. 10 is a right-side view of the connector assembly of FIG. 1 retained in the corresponding mounting bracket in accordance with one embodiment.

FIG. 3 is a rear view of the assembly 10 and illustrates the second end 22 of the housing 18. The second end 22 includes a second flange 46 extending beyond the bottom side 30 and extending beyond portions of both the first side 24 and the second side 26. The second flange 46 is positioned below the longitudinal plane 43 defined by the housing 18 and is orthogonal the longitudinal plane 43. The second flange 46 is configured to engage a face of the corresponding mounting bracket 54 (see FIG. 8) and inhibit movement along the mating axis 39. In an example the thickness of the second flange 46 is less than 1.5 mm.

Figure 5:
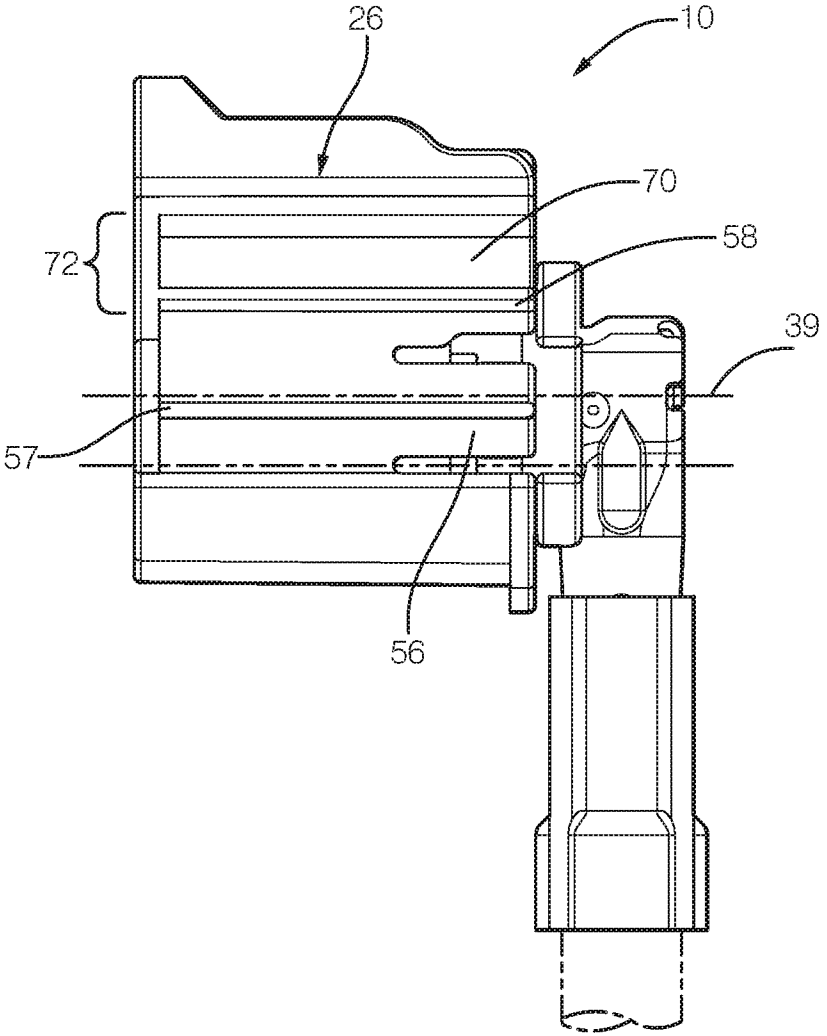
FIG. 5 is a second side view of the connector assembly of FIG. 1 in accordance with one embodiment.
Figure 4:
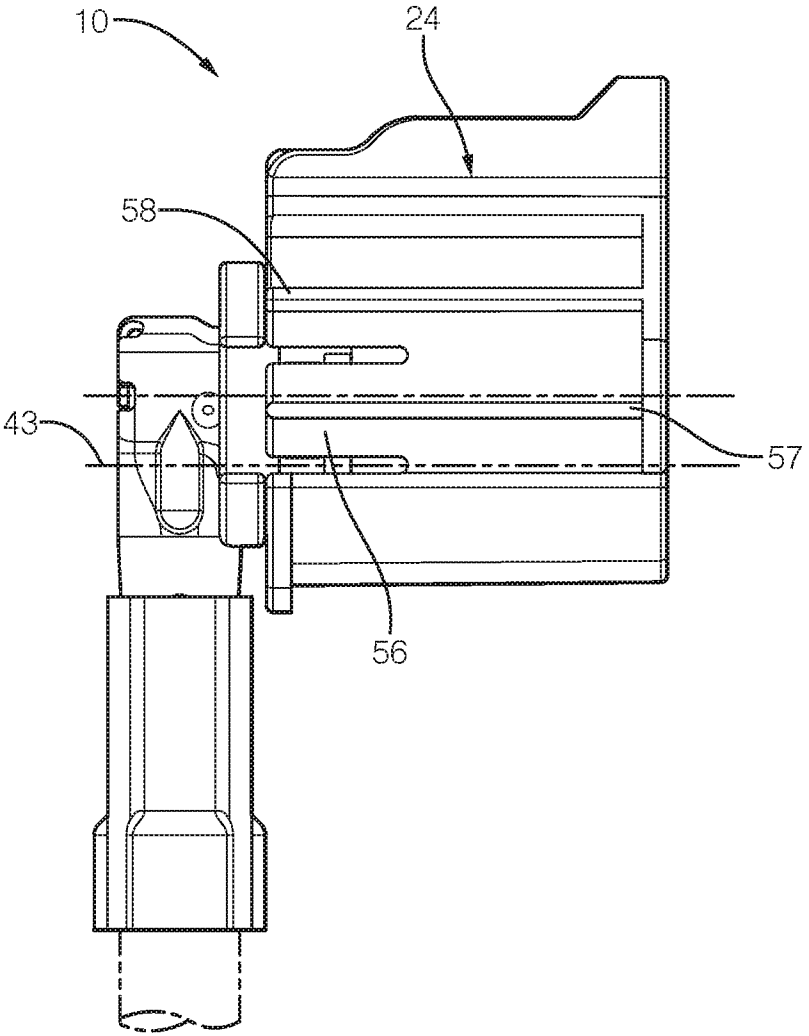
FIG. 4 is a first side view of the connector assembly of FIG. 1 in accordance with one embodiment.
Figure 15:
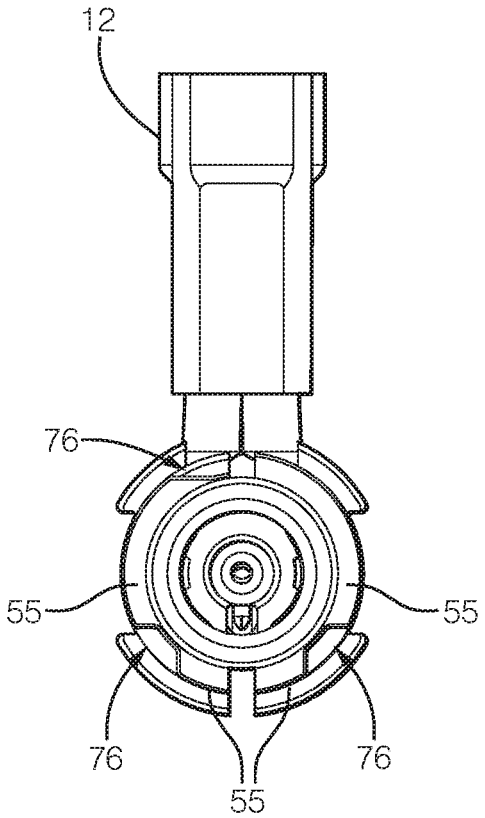
FIG. 15 is a front view of a coaxial electrical terminal of FIG. 1 in accordance with one embodiment.
Figure 16:
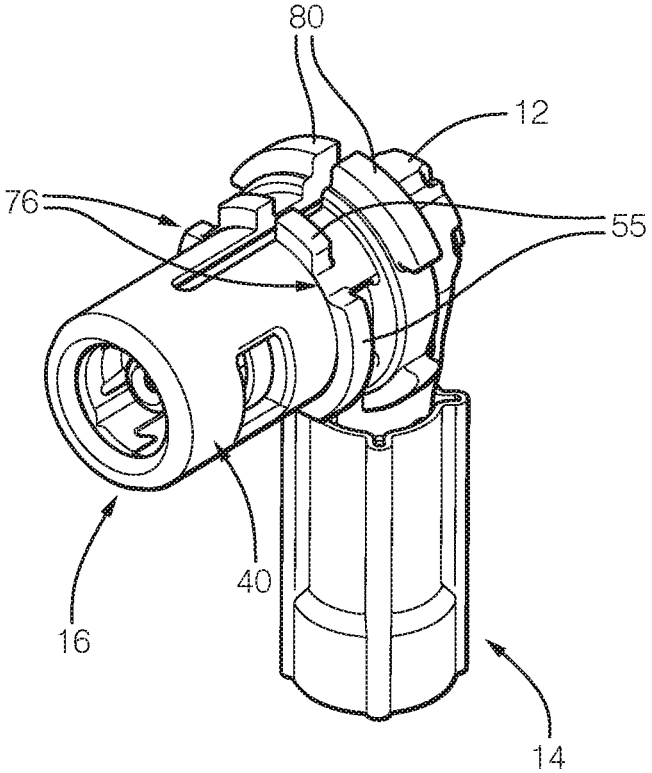
FIG. 16 is a rear view of the coaxial electrical terminal of FIG. 15 in accordance with one embodiment.

FIGS. 4-5 illustrate the first side 24 and the second side 26 of the assembly 10. The first side 24 and the second side 26 include opposed flexible locks 56 extending from middle sections of the first side 24 and the second side 26. The opposed flexible locks 56 are aligned parallel to the mating axis 39 of the assembly 10 and terminate at the second end 22 of the housing 18. The opposed flexible locks 56 are configured to removably retain the coaxial electrical terminal 12 within a cavity 32 defined by the housing 18 and inhibit movement of the coaxial electrical terminal 12 along the mating axis 39. The opposed flexible locks 56 include chamfers on leading edges of the opposed flexible locks 56. The chamfers engage lugs 55 on an outer surface 40 of the coaxial electrical terminal 12 (see FIGS. 15-16) that deflect the opposed flexible locks 56 outwardly as the coaxial electrical terminal 12 is inserted along the mating axis 39 into the housing 18. The opposed flexible locks 56 return to a relaxed state as the lugs 55 pass beyond the chamfers. In this relaxed state, the opposed flexible locks 56 lock against a back side of the lugs 55. The chamfers also enable a tool, such as a screwdriver, to be inserted between the opposed flexible locks 56 and the outer surface 40 of the coaxial electrical terminal 12, enabling a removal of the coaxial electrical terminal 12 from the housing 18.

In the examples illustrated in FIGS. 4-5, the first side 24 and the second side 26 include stiffening ribs 57 extending from the first end 20 to the second end 22. The stiffening ribs 57 are aligned parallel to the mating axis 39 and overlay the opposed flexible locks 56. The stiffening ribs 57 increase a stiffness of the opposed flexible locks 56 and increase a removal force required to remove the coaxial electrical terminal 12 from the housing 18. In an example, the height of the stiffening ribs 57 is between 0.5 mm and 1.0 mm.

The first side 24 and the second side 26 also include opposed locking ribs 58 extending beyond the first side 24 and the second side 26. The opposed locking ribs 58 are parallel to the mating axis 39 and extend from the first flange 42 and terminate at the second end 22. The opposed locking ribs 58 are positioned proximate the top side 28 and are configured to receive the locking arms 60 extending from the corresponding mounting bracket 54 (see FIGS. 8-12). The proximity of the opposed locking ribs 58 to the top side 28 further inhibits the rotation of the assembly 10 within the corresponding mounting bracket 54. In the examples illustrated in FIGS. 4-5, the opposed locking ribs 58 extend beyond the first side 24 and the second side 26 in a range of about 1.0 mm to about 2.0 mm. The opposed locking ribs 58 define a locking slot 70 that extends from the opposed locking ribs 58 to the top side 28 of the housing 18. The locking slot 70 is configured to receive ends of the locking arms 60 when the locking arms 60 engage the opposed locking ribs 58. In an example, the locking slot 70 has a height 72 of at least 5.0 mm. Referring back to FIG. 3, a lower surface 64 of the opposed locking ribs 58 define an angle 66 of less than 45 degrees relative to the first side 24 and the second side 26. An upper surface of the opposed locking ribs 58 defines an engagement angle 68 less than 90 degrees relative to the first side 24 and the second side 26. The engagement angle 68 is configured to retain the ends of the locking arms 60 extending from the corresponding mounting bracket 54.

Figure 6:
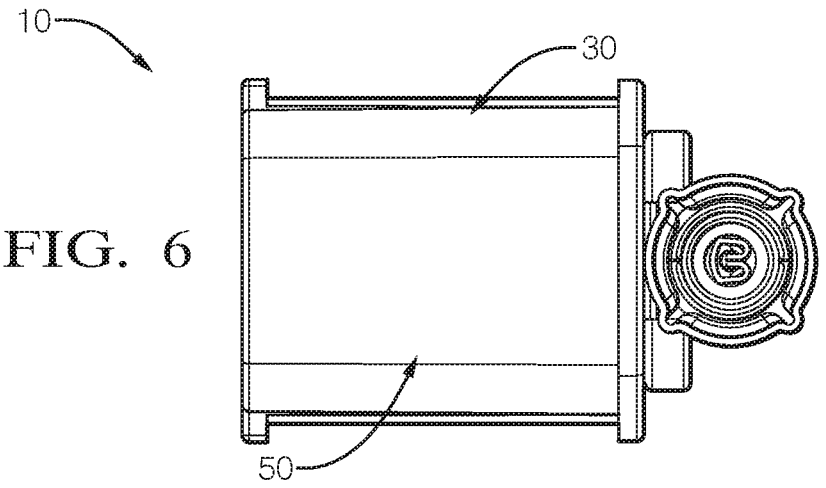
FIG. 6 is a bottom view of the connector assembly of FIG. 1 in accordance with one embodiment.
Figure 7:
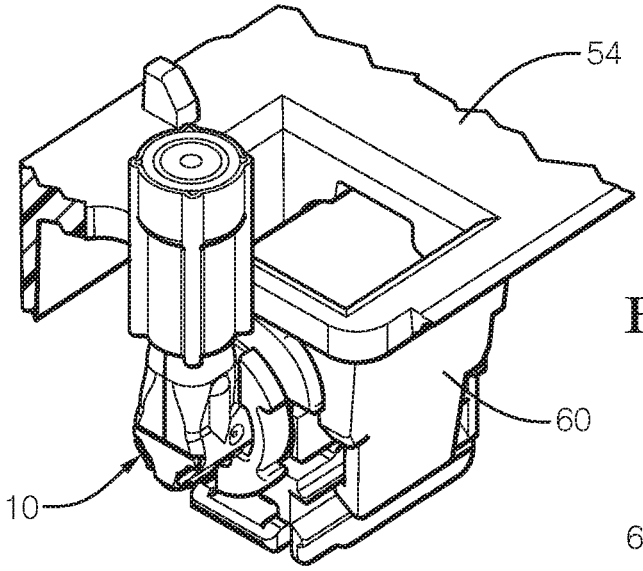
FIG. 7 is a bottom perspective view of the connector assembly of FIG. 1 retained in a corresponding mounting bracket in accordance with one embodiment.

FIG. 6 illustrates the bottom side 30 of the assembly 10. The bottom side 30 has a continuous surface 50 having a generally elliptically shaped profile 52 (see FIG. 2) configured to engage a bottom surface of the corresponding mounting bracket 54 (see FIGS. 7-11). The bottom surface of the corresponding mounting bracket 54 is configured to support the elliptically shaped profile 52 of the bottom side 30 of the housing 18, and further inhibits the rotation of the assembly 10 about the mating axis 39.

FIGS. 7-11 illustrate the assembly 10 retained in the corresponding mounting bracket 54. When the bottom side 30 of the assembly 10 engages the corresponding mounting bracket 54, the locking arms 60 impart a retention force 62 (see FIG. 8) on the opposed locking ribs 58 and inhibit the rotation of the housing 18 about the mating axis 39. As described above, the lower surface 64 of the opposed locking ribs 58 define the angle 66 of less than 45 degrees. The lower surface 64 of the opposed locking ribs 58 engages the ends of the locking arms 60 and deflects the locking arms 60 outwardly, enabling an engagement force sufficient to meet ergonomic requirements of the assembly process. The engagement angle 68 of the opposed locking ribs 58 (see FIG. 3) is configured to engage the ends of the locking arms 60 when the assembly 10 is seated in the corresponding mounting bracket 54 and inhibit the removal and rotation of the assembly 10.

Figure 14:
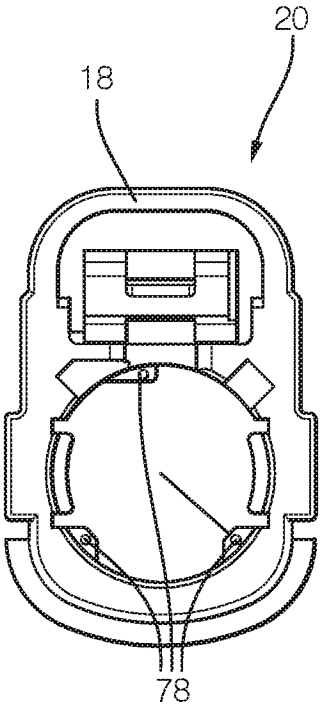
FIG. 14 is a rear view of the connector housing of FIG. 12 in accordance with another embodiment.
Figure 13:
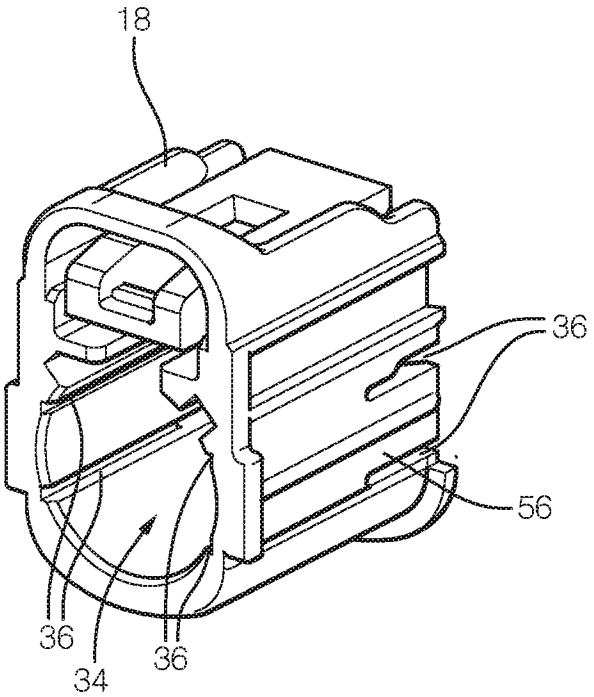
FIG. 13 is a front perspective view of the connector housing of FIG. 12 in accordance with another embodiment.
Figure 12:
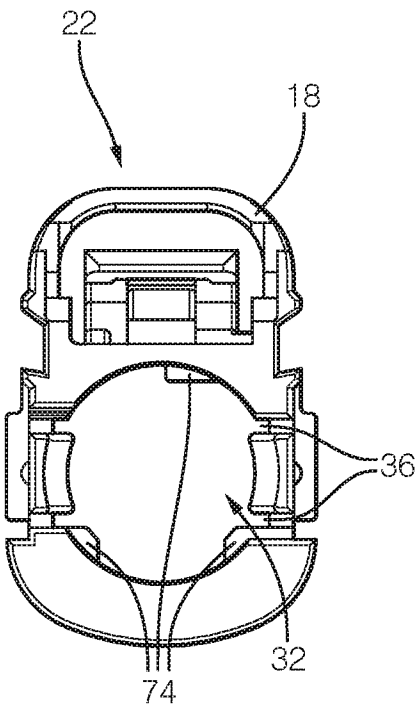
FIG. 12 is a front view of a connector housing of FIG. 1 in accordance with another embodiment.

FIGS. 12-14 illustrate the housing 18 isolated from the assembly 10. The cavity 32 defined by housing 18 is configured to receive the coaxial electrical terminal 12 through the second end 22 of the housing 18. The cavity 32 defines an inner surface 34 (see FIG. 13) that is generally cylindrically shaped to support the outer surface 40 of the coaxial electrical terminal 12. The inner surface 34 defines relief slots 36 configured to reduce strain limits on the flexible locks 56. The relief slots 36 extend from the first end 20 to the second end 22 and are aligned parallel to the mating axis 39. The relief slots 36 are positioned in the housing 18 so as to define an upper bound and a lower bound to each of the flexible locks 56.

FIG. 12 illustrates the housing 18 viewed from the second end 22. The housing 18 includes at least three tabs 74 extending beyond the inner surface 34 into the cavity 32 and are aligned orthogonal to the mating axis 39. The tabs 74 are configured to retain the coaxial electrical terminal 12 in the housing 18. As the coaxial electrical terminal 12 is inserted into the housing 18, cut-outs 76 in the lugs 55 (see FIGS. 14-15) of the coaxial electrical terminal 12 enable the coaxial electrical terminal 12 to move past the tabs 74 and be fully seated in the housing 18. Stops 80 (see FIG. 16) extending from the outer surface 40 of the coaxial electrical terminal 12 engage the second end 22 of the housing 18, when the coaxial electrical terminal 12 is fully seated in the housing 18, and control a depth of insertion of the coaxial electrical terminal 12. The coaxial electrical terminal 12 may then be rotated about the mating axis 39 so that at least two of the at least three tabs 74 engage the lugs 55 at positions away from the cut-outs 76, further inhibiting the removal of the coaxial electrical terminal 12 from the housing 18.

FIG. 14 illustrates the housing 18 viewed from the first end 20. Each of the at least three tabs 74 include a protrusion 78 extending from a surface of the tabs 74 toward the first end 20. The protrusions 78 are configured to engage the lugs 55 of the coaxial electrical terminal 12 when the coaxial electrical terminal 12 is fully seated in the housing 18 and is rotated about the mating axis 39. The protrusions 78 increase a frictional force between the tabs 74 and the lugs 55 that inhibits the rotation of the coaxial electrical terminal 12 within the housing 18.

Accordingly, a connector assembly 10 is provided. The connector assembly 10 is an improvement over other connector assemblies because the connector assembly 10 has the direct mount feature that inhibits the housing 18 from rotating within the corresponding mounting bracket 54.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. An electrical connector assembly, comprising:

a housing configured to receive an electrical terminal, wherein opposed sides of the housing each define a plurality of parallel locking ribs forming a locking slot therebetween, each locking slot configured to receive a locking arm extending from a separate mounting bracket.

2. The electrical connector assembly according to claim 1, wherein the electrical terminal is a right-angled coaxial terminal having a wire end and a terminal end oriented 90 degrees from the wire end.

3. The electrical connector assembly according to claim 2, wherein the locking arms of the separate mounting bracket are configured to impart a retention force on the locking ribs, thereby inhibiting rotation of the housing about a mating axis of the coaxial terminal.

4. The electrical connector assembly according to claim 2, wherein the housing defines a cavity in which the coaxial terminal is disposed and wherein the housing includes at least two tabs extending into the cavity along a direction orthogonal to a mating axis of the coaxial terminal.

5. The electrical connector assembly according to claim 4, wherein the at least two tabs are configured to engage lugs extending from an outer surface of the coaxial terminal.

6. The electrical connector assembly according to claim 5, wherein the at least two tabs each include a protrusion extending from a surface of at the least two tabs in a direction parallel to the mating axis and wherein the protrusions are configured to engage the lugs of the coaxial terminal when the coaxial terminal is rotated about the mating axis of the coaxial terminal.

7. The electrical connector assembly according to claim 5, wherein the housing includes at least three tabs extending into the cavity along a direction orthogonal to a mating axis of the coaxial terminal and wherein two of the at least three tabs are configured to engage the lugs extending from an outer surface of the coaxial terminal.

8. The electrical connector assembly according to claim 4, wherein the housing includes opposed flexible locks extending from a middle section of the housing and are parallel to the mating axis of the coaxial terminal and wherein the opposed flexible locks are configured to retain the coaxial terminal within the cavity.

9. The electrical connector assembly according to claim 8, wherein the housing includes stiffening ribs aligned parallel to the mating axis of the coaxial terminal and overlaying the opposed flexible locks.

10. The electrical connector assembly according to claim 9, wherein the housing includes stiffening ribs aligned parallel to the mating axis of the coaxial terminal and overlaying the opposed flexible locks.

11. The electrical connector assembly according to claim 1, wherein an end of the housing defines indexing features recessed into the housing, wherein the indexing features are configured to receive corresponding indexing features from a mating connector, and wherein the indexing features are compatible with a Fachkreis Automobil (FAKRA) standard.

12. The electrical connector assembly according to claim 1, wherein a bottom side of the housing defines a continuous surface having a generally elliptically shaped profile, the bottom side configured to engage the separate mounting bracket.

13. The electrical connector assembly according to claim 1, wherein the locking slots are arranged proximate a top side of the housing and are configured to receive the locking arms extending from the mounting bracket.

14. An electrical connector assembly, comprising:

a housing configured to receive an electrical terminal, wherein opposed sides of the housing each define a plurality of parallel locking ribs forming a locking slot therebetween; and a mounting bracket having a plurality of locking arms extending from the mounting bracket, wherein the locking arms engage the plurality of locking ribs and locking slots, thereby securing the housing to the mounting bracket.

15. The electrical connector assembly according to claim 14, wherein the mounting bracket is attached to a vehicle structure.

16. The electrical connector assembly according to claim 14, wherein the electrical terminal is a right-angled coaxial terminal having a wire end and a terminal end that are oriented 90 degrees from one another.

17. The electrical connector assembly according to claim 16, wherein the locking arms of the mounting bracket impart a retention force on the opposed locking ribs, thereby inhibiting rotation of the housing about a mating axis of the coaxial terminal.

18. The electrical connector assembly according to claim 16, wherein the housing defines a cavity in which the coaxial terminal is disposed and wherein the housing includes at least two tabs extending into the cavity along a direction orthogonal to a mating axis of the coaxial terminal.

19. The electrical connector assembly according to claim 18, wherein the at least two tabs are configured to engage lugs extending from an outer surface of the coaxial terminal.

20. The electrical connector assembly according to claim 19, wherein the at least two tabs include a protrusion extending from a surface of at the least two tabs in a direction parallel to the mating axis and wherein the protrusions are configured to engage the lugs of the coaxial terminal when the coaxial terminal is rotated about the mating axis of the coaxial terminal.

* * * * *